US008317956B2

(12) United States Patent
Greer

(10) Patent No.: US 8,317,956 B2
(45) Date of Patent: Nov. 27, 2012

(54) SYSTEM, METHOD, AND COMPOSITION FOR ADHERING PREFORMED THERMOPLASTIC TRAFFIC CONTROL SIGNAGE TO PAVEMENT

(76) Inventor: Robert W. Greer, Lexington, NC (US)

( * ) Notice: Subject to any disclaimer, the term of this patent is extended or adjusted under 35 U.S.C. 154(b) by 1305 days.

(21) Appl. No.: 11/226,838

(22) Filed: Sep. 14, 2005

(65) Prior Publication Data

US 2007/0059441 A1 Mar. 15, 2007

(51) Int. Cl.

| | |
|---|---|
| ***E04B 2/00*** | (2006.01) |
| ***E04F 13/00*** | (2006.01) |
| ***B05C 1/16*** | (2006.01) |
| ***B05D 5/00*** | (2006.01) |
| ***E01C 5/00*** | (2006.01) |
| ***E01C 11/24*** | (2006.01) |
| ***E01C 17/00*** | (2006.01) |
| ***B41M 5/00*** | (2006.01) |
| ***B44C 1/17*** | (2006.01) |
| ***G03G 7/00*** | (2006.01) |

(52) U.S. Cl. ..... 156/71; 427/136; 428/195.1

(58) Field of Classification Search ..... 156/71; 427/136; 428/195.1

See application file for complete search history.

(56) References Cited

U.S. PATENT DOCUMENTS

| | | | | |
|---|---|---|---|---|
| 4,118,376 | A | 10/1978 | Predauin et al. | |
| 4,532,274 | A | 7/1985 | Spurr | |
| 4,539,345 | A * | 9/1985 | Hansen | 523/219 |
| 4,960,620 | A | 10/1990 | House et al. | |
| 5,173,560 | A | 12/1992 | Gras et al. | |
| 5,189,075 | A * | 2/1993 | Zimmerman et al. | 521/159 |
| 5,391,015 | A | 2/1995 | Kaczmarczik et al. | |
| 5,759,695 | A | 6/1998 | Primeaux | |
| 5,962,144 | A | 10/1999 | Primeaux | |
| 5,985,986 | A | 11/1999 | Kubitza et al. | |
| 6,096,416 | A | 8/2000 | Altenberg | |
| 6,350,823 | B1 | 2/2002 | Goeb et al. | |
| 6,521,718 | B2 | 2/2003 | Goeb et al. | |
| 6,623,188 | B1 | 9/2003 | Dimmick | |
| 6,679,650 | B2 | 1/2004 | Britt et al. | |
| 6,780,459 | B2 | 8/2004 | MacPherson | |
| 6,787,596 | B1 | 9/2004 | Maier et al. | |
| 2002/0004116 | A1 * | 1/2002 | Friedrich et al. | 428/36.9 |
| 2002/0016421 | A1 | 2/2002 | Goeb et al. | |
| 2003/0109644 | A1 * | 6/2003 | Davis et al. | 525/390 |

FOREIGN PATENT DOCUMENTS

| | | | |
|---|---|---|---|
| EP | 1119587 | B1 | 9/2004 |
| JP | 03029404 | B2 | 4/2000 |
| WO | WO98/55525 | A1 | 12/1998 |
| WO | WO03064771 | A1 | 8/2003 |

OTHER PUBLICATIONS

Installation Instructions, "TopMark", Jul. 23, 2003.*

Portland Cement Association, Cement & Concrete Basics, http://www.cement.org/basics/concretebasics_concretebasics.asp, May 23, 2005, Portland Cement Association, Skokie, IL.

(Continued)

*Primary Examiner* — Michael Orlando

(74) *Attorney, Agent, or Firm* — Guerry L. Grune; ePatentManager.com

(57) ABSTRACT

The present invention relates to a method for adhering detectable warning devices, pavement markings and preformed traffic control devices (turn arrows, stop bars) that are hydrocarbon or alkyd thermoplastic in nature to an uncured or "green" concrete substrate providing permanent adhesion for detectable warning devices, pedestrian and traffic control markings.

11 Claims, 1 Drawing Sheet

Drawing of a Photomicrograph of Magnification is 200X

OTHER PUBLICATIONS

ESI, What is Polyurea?, http://www.elastomer.com/polymer/whatispolyurea.html May 24, 2005, Elastomer Specialties, Inc., Wagoner, OK.

Chemco Systems, http://www.chemcosystems.com/, May 24, 2005, ToTheWeb, San Mateo, CA.

Meeting the Challenge, Inc., Technical Requirements, http://www.adaportal.org/Facility_Access/ADAAG/Tech_Rqmts/ADAAG_4-29.html, May 23, 2005, ADA Document Portal, Washington D.C.

Dr. Shiwei Guan, Common Questions on 100% Solids Polyurethane Coatings, http://www.geocities.com/pucoating/faq1.htm, May 24, 2005, Question No. 8, p. 1 and p. 4, Geocities, Canada.

PDA, What is Polyurea?, http://www.pda-online.org/pda_resources/whatispoly.asp, May 23, 2005, pp. 1-2, Polyurea Development Association, Kansas City, MO.

AASHTO, Standard Specification for White and Yellow Reflective Thermoplastic Striping Material (Solid Form) AASHTO Designation M 249-98, ISBN:1-56051-164-8 (Set), 2001, pp. M249 1-2 and M249-4, 21st edition, AASHTO, Washington D.C.

AASHTO,Stand. Meth. of Test for "Thermoplastic Traffic Line Mat'l." AASHTO Desig: T 250-97,ISBN:1-56051-163-X(Part 2),2001, pp. T250-1-14, 21st edition, AASHTO,Washington D.C.

Flint Trading Inc., Installation Instructions, TopMark® Application Manual, Mar. 16, 2005, pp. 1-3, Flint Trading, Inc., Thomasville, NC.

* cited by examiner

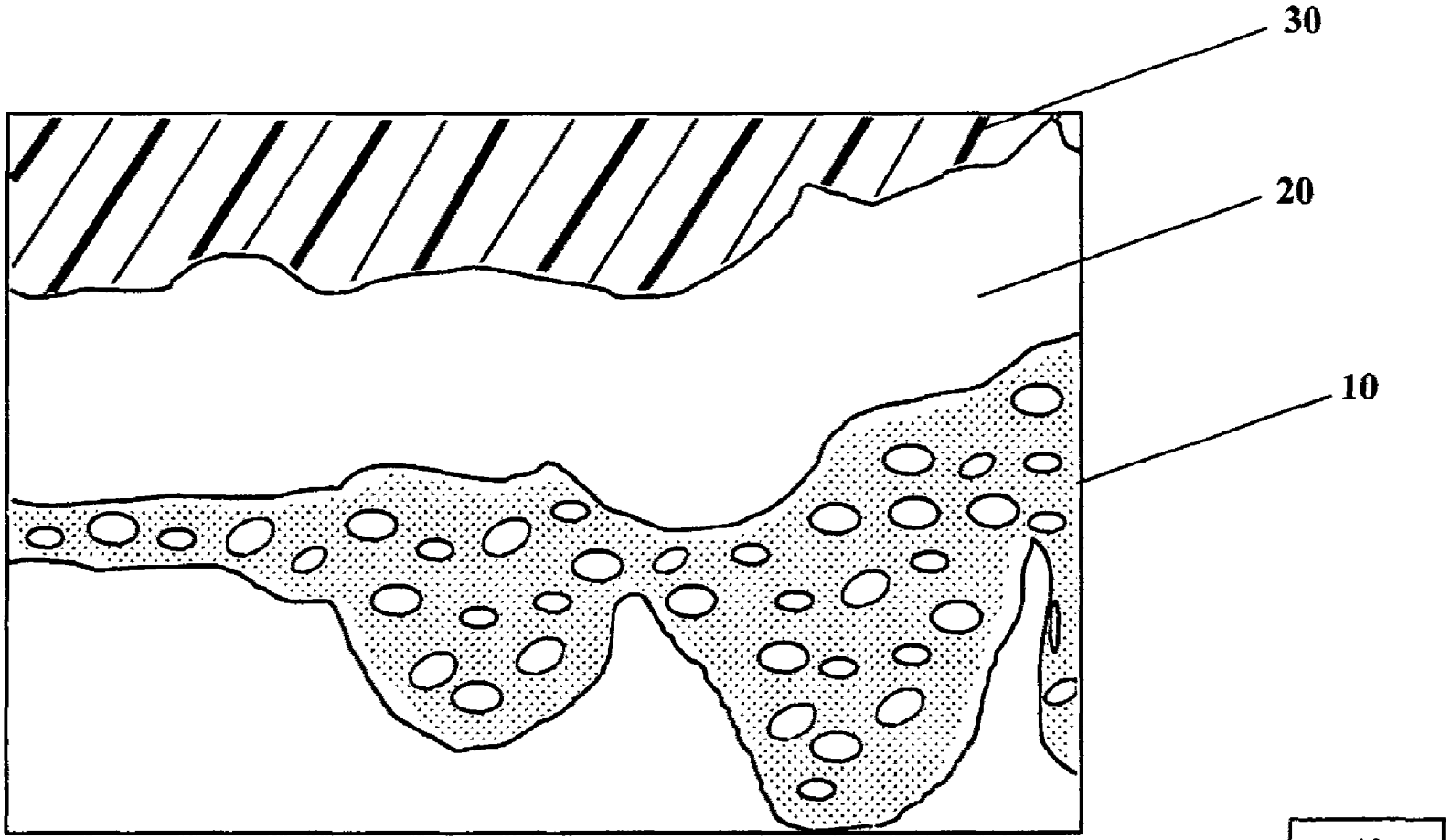
Drawing of a Photomicrograph of Magnification is 200X

SYSTEM, METHOD, AND COMPOSITION FOR ADHERING PREFORMED THERMOPLASTIC TRAFFIC CONTROL SIGNAGE TO PAVEMENT

FIELD OF INVENTION

The present invention relates to a system, method, and composition for adhering detectable warning devices, pavement markings and preformed traffic control devices (turn arrows, stop bars) that are hydrocarbon or alkyd thermoplastic based compositions to a bituminous or Portland concrete/cement surface to provide permanent pedestrian and traffic control markings.

BACKGROUND OF THE INVENTION

Pavement markings convey information to drivers and pedestrians by providing exposed visible, reflective and/or tactile surfaces that serve as indicia upon a traffic surface. In the past such a function was typically accomplished by painting a traffic surface. Modern pavement marking materials offer significant advantages over paint such as dramatically increased visibility and/or retroreflectance, improved durability, and temporary removable marking options. Examples of modern pavement marking materials are thermoplastic, pavement marking sheet materials, tapes and raised pavement markers.

The Americans with Disabilities Act of 1990, published requirements for sidewalk and other potentially dangerous areas in that detectable warning devices would be required to warn blind or visually impaired and wheelchair bound individuals of potentially dangerous and vehicular traffic areas. Of particular note is section 4.29, §§0.2 as restated below:

4.29 Detectable Warnings:

- 4.29.2 Detectable Warnings on Walking Surfaces. Detectable warnings shall consist of raised truncated domes with a diameter of nominal 0.9 in (23 mm), a height of nominal 0.2 in (5 mm) and a center-to-center spacing of nominal 2.35 in (60 mm) and shall contrast visually with adjoining surfaces, either light-on-dark, or dark-on-light. The material used to provide contrast shall be an integral part of the walking surface. Detectable warnings used on interior surfaces shall differ from adjoining walking surfaces in resiliency or sound-on-cane contact.
- 4.29.3 Detectable Warnings on Doors to Hazardous Areas.
- 4.29.4 Detectable Warnings at Stairs.
- 4.29.5 Detectable Warnings at Hazardous Vehicular Areas. If a walk crosses or adjoins a vehicular way, and the walking surfaces are not separated by curbs, railings, or other elements between the pedestrian areas and vehicular areas, the boundary between the areas shall be defined by a continuous detectable warning which is 36 in (915 mm) wide, complying with 4.29.2.
- 4.29.6 Detectable Warnings at Reflecting Pools. The edges of reflecting pools shall be protected by railings, walls, curbs, or detectable warnings complying with 4.29.2.

Detectable warning devices may be constructed as a preformed thermoplastic, thermoplastic, rubber, adhesive tile, tile cast into concrete, metal or other suitable material that will withstand abrasion and environmental extremes.

Formulations for preformed thermoplastic detectable warning devices, pavement markings and traffic control devices (preformed thermoplastic signage) are generically comprised of a:

- Binder (~20%) containing:
  - Resin:
    - Maelic modified resin ester
    - C5 hydrocarbon, (for hydrocarbon class)
    - Rosin ester (for alkyd class)
    - Plasticizer
    - Vegetable oils
    - Phthalate esters
    - Mineral oil
    - Castor oil
    - Wax/Flexibilizer
    - Paraffin wax
    - Polyamide
    - EVA or SBS elastomers
  - Pigment (2-10%):
    - Titanium dioxide
    - Lead chromate
    - Organic dyes
    - Filler (30-40%)
    - Calcium carbonate
    - Glass beads (30-40%)

wherein the thermoplastic signage may be alkyd or hydrocarbon based and includes a hot melt thermoplastic application. Thermoplastic signage must meet the standard specifications as published in the AASHTO (American Association of State Highway Transportation Officials) Designation: M 249-98.

Continuous and skip lane striping's on highways and pedestrian crosswalk markings employ preformed pavement marking sheeting preferably comprising a wear-resistant top layer optionally overlying a flexible base sheet. The top layer is generally highly visible, may include retroreflective elements to enhance detection when illuminated by traffic at night, and serves as indicia when installed upon the roadway surface. Application of temporary pavement marking sheeting to a traffic surface has typically been by contact cement or rubber-based pressure-sensitive adhesives. Traffic surfaces may include surfaces for pedestrians, motorized vehicles, aircraft, human powered conveyances, programmable robotics and the like.

Another example of a pavement marking is a raised pavement marker (i.e. a discreet marking structure with a rigid, semi-rigid or flexible marking body) which when applied to a roadway surface provides a raised surface. Often, the raised surface is both reflective and strategically oriented to enhance reflective efficiency when illuminated by traffic at night. In the case of rigid discreet markers, attachment of the body of each marker to the pavement surface has involved hot-melt adhesives or epoxy systems. Flexible body raised pavement markers have also been attached to pavement surfaces or pavement marking sheeting by soft butyl mastic materials.

In order to fulfill their function as indicia, both raised thermoplastic detectable warning devices, pavement markers and pavement marking sheeting must be applied to a rather troublesome substrate. That substrate, the traffic surface, varies widely in terms of surface properties because the underlying material may be concrete or asphalt, may be of varying age and temperature, and may, on occasion, be moist or damp or oily. Additionally, the roadway surface may vary in texture from rough to smooth. The substrate surface properties, therefore, represent a considerable challenge for attachment.

Specifically the standard for thermoplastic marking bond strength can be found in ASTM D4796-(2004), which states the test method and bonding strength of thermoplastic signage to concrete as: Bond Strength—After heating the thermoplastic material for four hours at 425 degrees F. the bond strength to Portland Cement Concrete shall exceed 1.24 Mpa (~180 psi). Preferably the bond strength is from about 200 psi to about 500 psi.

Thermoplastic signage therefore must reach a softening point within a range of about 400 degrees F. to about 450 degrees F. as determined by the ring and ball softening point test method specified in AASHTO Designation: M 249-98, section 12.

Concrete is a mixture of paste and aggregates. The paste, composed of Portland cement and water, coats the surface of the fine and coarse aggregates. Through a chemical reaction called hydration, the paste hardens and gains strength to form the rock-like mass known as concrete. Within this process lies the key to a remarkable trait of concrete: it is plastic and malleable when newly mixed, strong and durable when hardened. These qualities explain why concrete, can build superhighways, sidewalks, bridges, warehouse flooring, and other traffic media.

All Portland cements are hydraulic cements that set and harden through a chemical reaction with water. During this reaction, called hydration, a node forms on the surface of each cement particle. The node grows and expands until it links up with nodes from other cement particles or adheres to adjacent aggregates.

Curing begins after the exposed surfaces of the concrete have hardened sufficiently to resist marring. Curing ensures the continued hydration of the cement and the strength gain of the concrete. Concrete surfaces are cured by sprinkling with water fog, or by using moisture-retaining fabrics such as burlap or cotton mats. Other curing methods prevent evaporation of the water by sealing the surface with plastic or special sprays (curing compounds).

Some of the deficiencies associated with present pavement marking adhesion include the: (1) inability for signage to be adhered to uncured concrete which, depending on conditions, may take from about 8 days to about 21 days up to six months to exhibit a sufficient bonding surface, (2) inability to be applied due to limited adhesive tack at low temperature; (3) limited ability to accommodate surface roughness; (4) reduced durability, particularly at low temperature, when subjected to impact or shear; (5) increasing adhesion over time which in turn limits the duration of a period during which a temporary installation may be efficiently removed; and (6) staining of light colored concrete roadway surfaces by adhesives in removable markers.

Generally, the application of the thermoplastic or preformed thermoplastic signage requires that the concrete substrate be cured minimally from about 8 days to about 21 days before the application of the thermoplastic or preformed thermoplastic signage with some products requiring up to six months. Most preformed thermoplastic signage require the concrete substrate to be preheated to bring the concrete surface substrate up to a required temperature prior to application of the preformed thermoplastic signage. The signage is then heated over the pre-heated concrete surface to melt the signage into the porous surface of the concrete substrate. It is an additional feature of the present invention that this preheating requirement is avoided.

Where the traffic site is newly constructed concrete, the contracted signage application presently adds days to the completion of the project in that the application of thermoplastic detectable warning devices and pavement markers must have a cured surface to adhere to. In most concrete pedestrian traffic areas the concrete is ready for pedestrian traffic from about 72 hours to about 96 hours whereas the signage requires greater curing time for permanent application thereby leaving the traffic area non-ADA compliant.

Laitance (residual from concrete curing process) on the concrete surface must be removed and cleaned prior to application of the thermoplastic signage. Such residual is cleaned from the concrete surface via grinding or high pressure washing, leaving the concrete top surface wet. Most signage and adhesives require a clean dry surface for preferred adhesion properties. It is also an additional feature of the present invention that laitance removal is not required to establish a good bond to the Portland cement substrate.

Polyurea coatings may also be comprised of aspartic esters which provide amine functionality and a chemical backbone containing amine linkages. Polyurea is generally used as an industrial coating in severe environments such as with wet or damp surfaces with good chemical resistance to hydrocarbons. Polyurea systems may be applied via spray, 2-part caulk, pour, brush-on or other methods known to those skilled in the art.

In many cases, people tend to mix up polyurea coatings and polyurethane coatings. Thus polyurethane coatings have become a generic term for coating systems based on polyisocyanate reactions. Polyurea coatings normally use amines as coreactants to react with isocyanates. This reaction is extremely fast (within a few seconds or minutes). As a result, polyurea coatings tend to have a very limited pot life and their recoat time becomes a problem in cases where multiple coats are required. A polyurea linkage, however, will have better heat and high temperature resistance than a polyurethane system with polyols as coreactants (post-curing).

Polyurea can be defined as the result of a chemical reaction between an isocyanate and an amine. These amines are generally comprised of polyetheramines and a primary amine chain-extender which is used to impart hard block content and place the formulation on a volume ratio of about 1:1.

This two-component technology is based on an isocyanate quasi-prepolymer and an amine coreactant. Often an amine resin blend polyurea elastomer is made from an (A) component and a (B) component, where the (A) component has a quasi-prepolymer made from an isocyanate and an active hydrogen-containing material, such as a poly-oxyalkylenepolyamine, as described in U.S. Pat. No. 5,442,034 to Dudley J. Primeaux, II of Huntsman Petrochemical Corporation and herein incorporated by reference. The (B) component includes an amine resin, such as an amine-terminated polyoxyalkylene polyol which may be the same or different from the polyoxyalkylene poly-amine of the quasi-prepolymer. The viscosity of the (A) component is reduced by the inclusion of an organic, alkylene carbonate, such as ethylene carbonate, propylene carbonate, butylene carbonate, dimethyl carbonate and the like. The alkylene carbonate also serves as a compatibilizer between the two components, thus provided an improved mix of the system.

Preferably a two-part low viscosity adhesive would comprise a Part (A) component of about 300 centipoise (cp) and a Part (B) component of about 100 centipoise in an add mixture blend of about 250 centipoise.

U.S. Pat. No. 4,532,274, to Spurr, and assigned to Union Carbide, hereby incorporated by reference, describes epoxied formulations and reactions. An illustration of suitable cycloaliphatic epoxides are as follows:

Formula I

Diepoxides of cycloaliphatic esters of dicarboxylic acids having the formula:

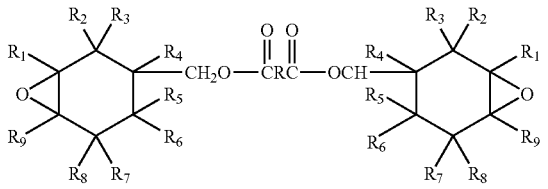

wherein R1 through R9, which can be the same or different are hydrogen or alkyl radicals generally containing one to nine carbon atoms inclusive and preferably containing one to three carbon atoms inclusive as for example methyl, ethyl, n-propyl n-butyl, n-hexyl, 2-ethylhexyl, n-octyl, n-nonyl and the like; R is a valence bond or a divalent hydrocarbon radical generally containing one to nine carbon atoms inclusive and preferably containing four to six carbon atoms inclusive, as for example, alkylene radicals, such as trimethylene, tetramethylene, pentamethylene, hexamethylene, 2-ethylhexamethylene, octamethylene, nonamethylene, and the like; cycloaliphatic radicals, such as 1,4-cyclohexane, 1,3-cyclohexane, 1,2-cyclohexane, and the like.

Particularly desirable epoxides, falling within the scope of Formula I, are those wherein R1 through R9 are hydrogen and R is alkylene containing four to six carbon atoms.

Among specific diepoxides of cycloaliphatic esters of dicarboxylic acids are the following:

bis(3,4-epoxycyclohexylmethyl)oxalate,
bis(3,4-epoxycyclohexylmethyl)adipate,
bis(3,4-epoxy-6-methylcyclohexylmethyl)adipate,
bis(3,4-epoxycyclohexylmethyl)pimelate, and the like. Other suitable compounds are described in U.S. Pat. No. 2,750,395 to B. Phillips et al.

Formula II

A 3,4-epoxycyclohexylmethyl 3,4-epoxycyclohexane carboxylate having the formula:

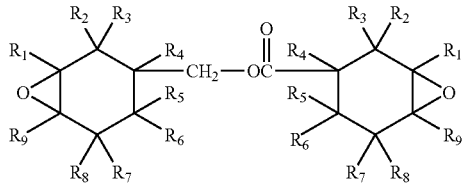

wherein R1 through R9 which can be the same or different are as defined for R1 in formula I. Particularly desirable compounds are those wherein R1 through R9 are hydrogen. Among specific compounds falling within the scope of Formula II are the following: 3,4-epoxycyclohexylmethyl, 3,4-epoxycyclohexanecarboxylate, 3,4-epoxy-1-methylcyclohexylmethyl, 3,4-epoxy-1-methylcyclohexylmethyl, 3,4-epoxy-1-methylcyclohexanecarboxylate, 6-methyl-3,4-epoxycyclohexylmethyl, 6-methyl-3,4-epoxycyclohexanecarboxylate, 3,4-epoxy-3-methylcyclohexylmethyl, 3,4-epoxy-3-methylcyclohexanecarboxylate, 3,4-epoxy-5-methylcyclohexylmethyl, 3,4-epoxy-5-methylcyclohexanecarboxylate. Other suitable compounds are described in U.S. Pat. No. 2,890,194 to B. Phillips et al.

Formula III

Diepoxides having the formula:

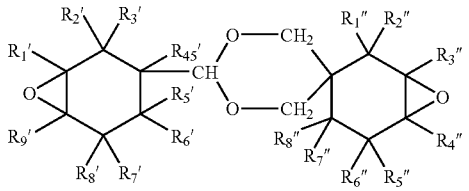

wherein the R single and double primes, which can be the same or different, are monovalent substituents such as hydrogen, halogen, i.e., chlorine, bromine, iodine or fluorine, or monovalent hydrocarbon radicals, or radicals as further defined in U.S. Pat. No. 3,318,822 to Hans Batzer et al. Particularly desirable compounds are those wherein all the R's are hydrogen.

Other suitable cycloaliphatic epoxides are the following:

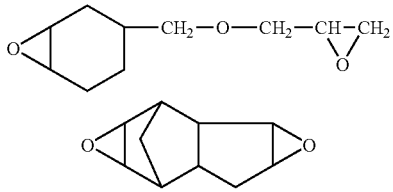

and the like.

The preferred cycloaliphatic epoxides are the following:

3,4-Epoxycyclohexylmethyl-3,4-Epoxycyclohexanecarboxylate

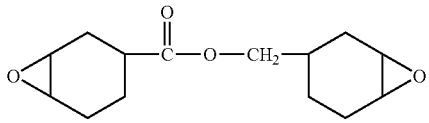

Bis-(3,4-Epoxycyclohexylmethyl) Adipate

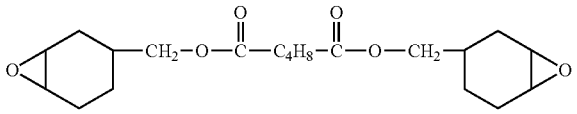

2-(3,4-Epoxycyclohexyl-5,5,spiro-3,4-epoxy) cyclohexane-meta-dioxane

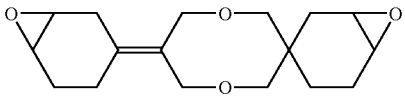

vinyl cyclohexane Dioxide

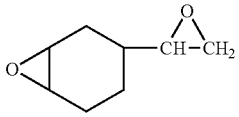

or mixtures thereof.

Epoxides with six membered ring structures may also be used, such as diglycidyl esters of phthalic acid, partially hydrogenated phthalic acid or fully hydrogenated phthalic acid. Diglycidyl esters of hexahydrophthalic acids being preferred. Mixtures of epoxide resins may also be used.

The glycols suitable for use in this invention include polycaprolactone polyols as well as alkylene oxide adducts of polyhydroxyalkanes. Illustrative of the polycaprolactone polyols that can be used one can mention the reaction products of a polyhydroxyl compound having from 2 to 6 hydroxyl groups with caprolactone. The manner in which these polycaprolactone polyol compositions are produced is shown in, for example, U.S. Pat. No. 3,169,945 and many such compositions are commercially available. In the following table there are listed illustrative polycaprolactone polyols. The first column lists the organic functional initiator that is reacted with caprolactone and the average molecular weight of the polycaprolactone polyol is shown in the second column.

Knowing the molecular weights of the initiator and of the polycaprolactone polyol one can readily determine the average number of molecules of caprolactone (CPL Units) that reacted to produce the compound; this figure is shown in the third column.

POLYCAPROLACTONE POLYOLS

| | Initiator of polyol in molecules | Average MW | Average No. of CPL Units |
|---|---|---|---|
| 1 | Ethylene glycol | 290 | 2 |
| 2 | Ethylene glycol | 803 | 6.5 |
| 3 | Ethylene glycol | 2,114 | 18 |
| 4 | Propylene glycol | 874 | 7 |
| 5 | Octylene glycol | 602 | 4 |
| 6 | Decalence glycol | 801 | 5.5 |
| 7 | Diethylene glycol | 527 | 3.7 |
| 8 | Diethylene glycol | 847 | 6.5 |
| 9 | Diethylene glycol | 1,246 | 10 |
| 10 | Diethylene glycol | 1,998 | 16.6 |
| 11 | Diethylene glycol | 3,526 | 30 |
| 12 | Triethylene glycol | 754 | 5.3 |
| 13 | Polyethylene glycol (MW 200)* | 713 | 4.5 |
| 14 | Polyethylene glycol (MW 600)* | 1,396 | 7 |
| 15 | Polyethylene glycol (MW 1500)* | 2,868 | 12 |
| 16 | 1,2-Propylene glycol | 646 | 5 |
| 17 | 1,3-Propylene glycol | 988 | 8 |
| 18 | Dipropylene glycol | 476 | 3 |
| 19 | Polypropylene glycol (MW 425)* | 824 | 3.6 |
| 20 | Polypropylene glycol (MW 1000)* | 1,684 | 6 |
| 21 | Polypropylene glycol (MW 2000)* | 2,456 | 4 |
| 22 | Hexylene glycol | 916 | 7 |
| 23 | 2-Ethyl-1,3-hexanediol | 602 | 4 |
| 24 | 1,5-Pentanediol | 446 | 3 |
| 25 | 1,4-Cyclohexanediol | 629 | 4.5 |
| 26 | 1,3-Bis (hydroxyethyl)-benzene | 736 | 5 |
| 27 | Glycerol | 548 | 4 |
| 28 | 1,2,6-Hexanetriol | 476 | 3 |
| 29 | Trimethylolpropane | 590 | 4 |
| 30 | Trimethylolpropane | 761 | 5.4 |
| 31 | Trimethylolpropane | 1,103 | 8.5 |
| 32 | Triethanolamine | 890 | 6.5 |
| 33 | Erythritol | 920 | 7 |
| 34 | Pentaerythritol | 1,219 | 9.5 |

*= Average molecular weight of glycol.

The structures of the compounds in the above tabulation are obvious to one skilled in the art based on the information given. The structure of compound No. 7 is:

$$HO[(CH_2)_5\overset{\overset{O}{\|}}{C}O]_r CH_2CH_2OCH_2CH_2[O\overset{\overset{O}{\|}}{C}(CH_2)_5]_r OH$$

wherein the variable r is an integer, the sum of r+r has an average value of 3.7 and the average molecular weight is 527. The structure of compound No. 20 is:

$$HO[(CH_2)_5\overset{\overset{O}{\|}}{C}O]_r(C_3H_6O)_n C_3H_6[O\overset{\overset{O}{\|}}{C}(CH_2)_5]_r OH$$

wherein the sum of r+r has an average value of 6 and the average molecular weight of 1,684. This explanation makes explicit the structural formulas of compounds 1 to 34 set forth above.

Illustrative alkylene oxide adducts of polyhydroxyalkanes include, among others, the alkylene oxide adducts of ethylene glycol, propylene glycol, 1,3-dihydroxypropane, 1,3-dihydroxybutane, 1,4-dihydroxybutane, 1,4-1,5- and 1,6-dihydroxyhexane, 1,2-, 1,3-, 1,4-, 1,6-, and 1,8-dihydroxyoctane, 1,10-dihydroxydecane, glycerol, 1,2,4-trihydroxybutane, 1,2,6-trihydroxyhexane, 1,1,1-trimethylolethane, 1,1,1-trimethylolpropane, pentaerythritol, caprolactone, polycaprolactone, xylitol, arabitol, sorbitol, mannitol, and the like; preferably the adducts of ethylene oxide, propylene oxide, epoxybutane, or mixtures thereof. A preferred class of alkylene oxide adducts of polyhydroxyalkanes are the ethylene oxide, propylene oxide, or mixtures thereof, adducts of trihydroxyalkanes. The preferred alkylene oxide adducts of polyhydroxyalkanes are of the following formula:

$$R_{10}\text{—}[O(CH_2\text{—}\underset{\underset{CH_3}{|}}{CH}\text{—}O)_n H]_3$$

wherein R10 is alkane of 3 to 10 carbon atoms, preferably 3 carbon atoms, and n is an integer of from about 4 to about 25.

It is customary to add appropriate hardeners to epoxide compositions to effect cure. Among suitable hardeners are the following: 1. polybasic acids having at least 2 carboxylic acid groups per molecule. 2 anhydrides of acids having at least 2 carboxylic acid groups per molecule.

Illustrative of suitable polybasic acids are the polycarboxylic acids of the formula:

$$HOOC\text{—}(CH_2)_f\text{—}COOH$$

wherein f is an integer generally having a value of from 1 to 20 inclusive, as for example, malonic, glutaric, adipic, pimelic, suberic, azelaic, sebacic and the like. Other examples of suitable acids are phthalic acid, isophthalic acid, terephthalic acid, hexahydrophthalic acid, and the like. Further acids are enumerated in U.S. Pat. No. 2,918,444 to B. Phillips et. al.

Among other suitable polybasic acids, having at least two carboxylic groups per molecule, can be noted the following: tricarballylic acid, trimellitic acid and the like. Other such suitable polybasic acids, including polyesters thereof, are described in U.S. Pat. No. 2,921,925 to B. Phillips et al.

Suitable anhydrides are the anhydrides of the acids listed above.

For purposes of stoichiometric calculations with respect to acids, one carboxyl group is deemed to react with one epoxy group; with respect to anhydrides, one anhydride group is deemed to react with one epoxy group. The curable epoxy comprises a one part or multiple part composition or mixture and the mixture is optionally a isocyanate-functional prepolymer, an effective amount of terpene phenolic resin, and an effective amount of a silane compound.

Preferred hardeners include methyltetrahydrophthalic anhydride, hexahydrophthalic anhydride and methylhexahydrophthalic anhydride.

In an embodiment of this invention, the hardener such as the anhydride may be reacted with the glycol and this reacted product added to the epoxide.

It is to be understood that other additives can be added to the compositions of this invention as is well known in the epoxy art. These additives include the following: modifiers such as dimer acid (made from unsaturated $C_{18}$ fatty acids and is a mixture of 3 percent mono basic acids, 75 percent dimer acid and 22 percent trimer acid and sold under the name of Empol 1022 by Emery Industries), a carboxyl terminated butadiene acrylonitrile (80-20) random copolymer having a molecular weight of about 3300; fillers such as clay, silica, aluminum trihydride, or mixtures thereof which may be coated with, for example, silanes, which fillers may be added in amounts of up to about 60 percent; pigments such as carbon black; mold release agents, and the like.

The compositions of this invention are prepared by simply mixing the epoxide, glycol, catalyst, hardener and other ingredients at room or higher temperatures in a suitable container. Also, the epoxide and glycol may be mixed in one container and the hardener, catalyst and/or accelerator in another container and these two mixed.

The composition is then heated in order to effect its cure. The temperature to which the composition of this invention are heated to effect cure will, of course, vary and depend, in part upon the exact formulations of the composition. Generally, temperatures in the range of about 100° C. to about 200° C. are used for a period of time ranging from about 1 to about 6 hours.

The compositions of this invention are preferably used to fabricate thermoset resin articles by the procedure as set forth in U.S. patent application Ser. No. 430,366, filed in the names of R. Angell et al., titled "A Process For Fabricating Thermoset Resin Articles" and filed on the same data as this application. The process described in said application Ser. No. 430,366 comprises the steps of (a) providing in an accumulator zone, a liquid body of an epoxide containing organic material which is curable upon heating to a thermoset resin composition, the viscosity of said liquid body being maintained essentially constant in the accumulator zone by keeping its temperature below that at which curing of said materials is substantial, (b) providing a heated closed mold from which essentially all of the air has been removed from the cavity in said mold, (c) injecting at least a portion of said liquid body under pressure into the closed mold to fill the cavity in the mold, (d) initiating the curing of said materials by subjecting the materials to a temperature in the mold above the temperature at which the curing of said materials is initiated, (e) maintaining a pressure on the curing material, (f) injecting additional of said materials to the mold cavity during the curing of said materials, and (g) opening said mold and removing the article therefrom.

Other processes known in the art may be used to formulate the compositions of this invention.

EXAMPLES

The following Examples serve to give specific illustration of the practice of this invention but they are not intended in any way to act to limit the scope of this invention.

The following designations used in the Examples have the following meanings:

Epoxy 1=3,4-epoxycyclohexyl-3,4-epoxycyclohexane carboxylate

HHPA=hexahydrophthalic anhydride

ATH=aluminum trihydrate treated with a 1% by weight of a mixture of one part of beta(3,4-epoxycyclohexyl)ethyltrimethoxysilane and three parts of n-octyltriethoxysilane.

Polyol 1=polycaprolactone polyol having a molecular weight of 1250.

Polyol 2=polypropylene oxide triol having a molecular weight of 710.

Polyol 3=polypropylene oxide triol having a molecular weight 5000.

Catalyst 1=benzyl dimethyl amine.

Catalyst 2=2-methylimidazole.

Catalyst 3=the reaction product of imidazole and propylene oxide.

Catalyst 4=2-phenyl-imidazole.

Catalyst 5=1-vinyl-2-methylimidazole.

Catalyst 6=1,4-diazobicyclo[2.2.2]octane.

Catalyst 7=1-methylimidazole.

Catalyst 8=a mixture of 70 percent of bis(dimethylamino ethyl ether) and 30 percent dipropyleneglycol.

Catalyst 9=bis(dimethylamino ethyl ether).

Catalyst 10=n-propyl triphenyl phosphonium bromide.

Preparation of Formulations

In preparation for incorporation into a formulation, the filler was dried for about 12 hours in an air oven at 100° C. The other ingredients were separately heated to 80° C. in an air oven for about 30 minutes just prior to use. When used, solid catalysts were dissolved by stirring them into the anhydride during the period the ingredients are heated to 80° C.

Liquid components of a formulation which were heated to 80° C. were rapidly mixed together by hand and the filler was rapidly stirred into the liquid composition. A timer was started to record pot-life data. The hand mixed composition (about 2 pounds total weight) was sheared on a Cowles Dissolver for 60 seconds and then placed in a large vacuum chamber. The pressure was reduced to about 30 inches of mercury (as read on a mechanical gauge) to de-aerate the mix. The vacuum was released as soon as the foam head which had formed collapsed, as seen through a viewpoint on the vacuum chamber. The time required for this procedure beginning with the starting of the time was about five minutes. The temperature of the formulation at this point was usually 80°+−0.2° C.

One half of the mix was immediately poured into an aluminum cavity mold which was pre-heated to 150° C. (the mold cavity is 2 inches in diameter and 2½ inches deep, the walls are 1 inch thick). The mold was situated in a circulating air oven at 150° C. The temperature of the mold was monitored by a thermocouple placed mid-way in the mold wall. After filling the mold to within about ¼ inch to ½ inch from the top, an aluminum cap (at 150° C.) was placed over the mold. The cap held a thermocouple in its center which protruded to the center of the formulation (1 inch from the mold wall and bottom inside surfaces). A strip recorder was used to follow the exotherm profile. Immediately after filling the mold cavity, the other half of the formulation was poured into an 8 ounce metal can. The can was placed in a circulatory silicone oil bath at 80° C. A Brookfield viscometer (Model HAT, Spindle N. 4, 20 RPM) was used to follow the viscosity of the formulation with time. The first viscosity reading was routinely taken six minutes after the start of the time noted above.

Pot-life was measured by the time for the formulation to reach a specific viscosity at 80° C. (3000 centipoise and 20,000 centipoise). Cure speed was measured by the time from mold fill to peak exotherm in the 150° C. cavity mold. Peak exotherm temperature was also recorded.

Control A and Examples 1 to 7

The ingredients in Table I were formulated as described in Preparation of Formulations, supra and tested as described above. The test results are shown in Table II.

TABLE I

| | Example* | | | | | | | |
|---|---|---|---|---|---|---|---|---|
| | Control A | 1 | 2 | 3 | 4 | 5 | 6 | 7 |
| Epoxy I | 80 | 80 | 80 | 80 | 80 | 80 | 80 | 85 |
| Polyol I | 20 | 20 | 20 | 20 | 20 | 20 | 20 | 35 |
| HHPA | 70.4 | 70.4 | 70.4 | 70.4 | 70.4 | 70.4 | 70.4 | 73.33 |
| | Catalyst | | | | | | | |
| Type | Catalyst 1 | Catalyst 2 | Catalyst 2 | Catalyst 3 | Catalyst 4 | Catalyst 5 | Catalyst 6 | Catalyst 6 |
| Amount | 3.4 | 1.7 | 0.42 | 1.7 | 1.7 | 1.7 | 0.85 | 0.87 |
| ATH | 260.7 | 258.2 | 258.2 | 258.2 | 258 | 258 | 257 | 261.3 |

*All numbers represent parts by weight

TABLE II

| | Example | | | | | | | |
|---|---|---|---|---|---|---|---|---|
| | Control A | 1 | 2 | 3 | 4 | 5 | 6 | 7 |
| Time for Viscosity to reach 3000 centipoise at 80° C. (min) | 75 | 36 | 62 | 32 | 100 | 47 | 34 | 57 |
| Gel time at 150° C. (min) | 9 | 5 | 6 | 4 | 9.5 | — | — | 42 |
| Time to peak Exotherm (min) | 15.5 | 10 | 8.4 | 8.8 | 10.3 | 7.3 | 8.7 | 9 |
| Peak Exotherm (° C.) | 188 | 210 | 200 | 207 | 208 | 206 | 187 | 189 |

Examples 8 to 12

The ingredients in Table III were formulated as described in Preparation of Formulations, supra, and tested as described above. The test results are shown in Table IV.

TABLE III

| | Example* | | | | |
|---|---|---|---|---|---|
| | 8 | 9 | 10 | 11 | 12 |
| Epoxy I | 80 | 80 | 80 | 80 | 80 |
| Polyol II | 10 | 10 | 10 | 10 | 10 |
| Polyol III | 10 | 10 | 10 | 10 | 10 |
| HHPA | 70.4 | 70.4 | 70.4 | 70.4 | 70.4 |
| | Catalyst | | | | |
| Type | Catalyst 6 | Catalyst 7 | Catalyst 8 | Catalyst 9 | Catalyst 10 |
| Amount | 0.85 | 0.43 | 1.7 | 1.7 | 0.85 |
| ATH** | 256 | 256 | 256 | 256 | 256 |

*All numbers represent parts by weight

**The ATH was untreated

TABLE IV

| | Example | | | | |
|---|---|---|---|---|---|
| | 8 | 9 | 10 | 11 | 12 |
| Time for viscosity to reach 20,000 centipoise at 80° C. (min) | 57 | 84 | 90 | 64 | 70 |
| Time to peak Exotherm (min) | 9.8 | 10.3 | 9.9 | 9.7 | 8.0 |
| Peak Exotherm (° C.) | 189 | 201 | 198 | 196 | 198 |

Zumar Signs, a company that provides road signage, teaches away from using an adhesive and relies on heat only. Zumar markets Stimsonite (now Zumar) Hot Tape which claims the following advantages:

Year-round application in temperatures as low as 32 F
No primers or adhesives required
Excellent retroreflectivity by incorporating both large and normal size glass beads
No cracking due to material contracting or expanding
Impervious to vehicle oil and grease
Environmentally safe: contains no VOCs; no primers/adhesives; lead free pigments
No heavy thermoplastic application equipment
Bonds to all primary substrates such as asphalt, concrete and brick
Easily checked for bond
Flexible and uniform pre-beading for easier handling and installation
Available in 90 and 120 mil thicknesses
90 mil straight lines are available in rolls for yellow and white; all other items are shipped in 3-ft. lengths
Standard colors: White, Yellow, Blue and Black
All standard legends and symbols comply with MUTCD standards and widths The practical significance of deficiencies of providing an adhesive system includes a tendency towards either inadequate initial bonding (i.e. through insufficient adhesive tack), inadequate permanent bonding of a marking sheet to the traffic surface, the requirement to preheat the pavement, poor bond on Portland cement concrete which has not dried out or cured sufficiently, or poor bond on Portland cement concrete surfaces where the laitance has not been removed. Some pavement marking sheets have a somewhat elastic nature and their slow but progressive tendency toward recovery after initial application may exceed adhesive forces bonding the sheet to the pavement and result in the pavement marking sheet becoming detached. Once the pavement marking sheet becomes prematurely detached from a roadway surface, advantages such as more effective visibility and potentially longer service life cannot be realized. Further, inadequate adhesive tack at low temperature limits the application season in many locations which in turn leads to less efficiently marked traffic projects.

In view of the above-described deficiencies associated with adhesion of detectable warning devices or pavement marking sheets or raised pavement markers to roadway surfaces, a desirable adhesive method would embody the following properties:

1. Extended temperature range for application.
2. Durability of application/adhesion.
3. Acceptable cost.
4. Efficient installation.
5. No preheating requirement.
6. No laitance removal on Portland cement concrete.
7. No drying of the Portland cement concrete.
8. Ability to adhere to uncured Portland cement concrete.

The present invention, as disclosed below, satisfies these requirements with a method for applying thermoplastic (preformed) detectable warning devices and pavement markings to uncured concrete thereby speeding construction processes, enabling a more rapid compliance for ADA regulations and potentially reducing construction schedules.

DESCRIPTION OF THE PRIOR ART

U.S. Pat. No. 4,532,274 to Spurr, and assigned to Union Carbide, describes a curable molding composition comprising an epoxide resin, a polyol, a hardener, and a catalyst selected from the group consisting of amine, quaternary ammonium or phosphonium compounds characterized by a peak exotherm of 210° C. or less which is generally an epoxy composition that is heat curable. This invention is in regards to a curable composition and does not enter make any method claims in regards to a specific substrate. The present invention utilizes a similar composition for a concrete substrate wherein a thermoplastic composition may be placed and adhered utilizing heat.

U.S. Pat. No. 6,096,416 to Altenberg, describes a poured-in-place sandwich panel utilizing a polyisocyanurate or polyurethane foam core containing glass fibers to mate two metal panels together. This invention exhibits the use of polyurea in fastening surfaces together however is specific to adhering metal panels together.

U.S. Pat. No. 5,759,695 to Primeaux, and assigned to Huntsman Chemical, and hereby fully incorporated by reference, describes a polyurea elastomer system with improved adhesion to a substrate with the use of a primer that is applied first wherein the primer is a separate step prior to the application of the polyurea elastomer. The primer is composed of hydrophobic, primary hydroxyl-containing compound, for example, castor oil, and an isocyanate. A polyurea elastomer is applied over the primer which is adhered to substrates such as concrete, wood, metal, asphalt, plaster, tile, mortar, grout, and brick. The primer and elastomer are essential for strengthening the surface of the substrates and curing does not involve application of heat.

U.S. Pat. No. 5,962,144 to Primeaux, and assigned to Huntsman Chemical, also hereby fully incorporated by reference, is a continuation of U.S. Pat. No. 5,759,695 and describes an improved primer/elastomer formulation wherein regardless of whether the substrate is dry or wet, adhesion is improved utilizing normal curing.

U.S. Pat. No. 6,780,459 to Macpherson, describes a method for stabilizing irregular rock, concrete and molding tool structures, the method comprising concurrently heating and mixing a mixture of polyoxypropylene diamine with an aromatic diamine liquid in about a 2:1 to 1:1 ratio mechanically purging the mixture under pressure and combining a polyurea mixture with fibrous mesh, foam or geotextile mat for stability. This invention demonstrates viability to coat irregular and uneven, however combines polyurea and material that is spray applied to a surface for strengthening a surface. The present invention utilizes the application of a polyurea elastomer to irregular concrete traffic surfaces and applying thermoplastic signage to the polyurea elastomer and curing and bonding the signage to the polyurea elastomer and concrete substrate by the use of heat.

U.S. Pat. No. 4,539,345 to Hansen, and assigned to 3M Innovative Properties Company, hereby incorporated by reference describes a one-part moisture-curable polyurethane composition and a method whereby for coating a first substrate, or for bonding a second substrate thereto, comprising the steps of applying to said first substrate a layer of one-part moisture-curable polyurethane optionally applying said second substrate to said layer, and allowing said composition to cure.

U.S. Pat. No. 5,391,015 to Kaczmarczik, et. al., and assigned to 3M Innovative Properties Company, describes a pavement marker having an upper surface and comprising a bottom layer of polyorganosiloxane pressure-sensitive adhesive and the roadway surface has a temperature below 15 degree. C. This invention is for a pavement marker with a pressure sensitive adhesive applied to the pavement marker. The method of applying the pavement marker does not involve the application of polyurea to the substrate or of applying heat to the marker to bond the marker to the traffic surface.

U.S. Patent Application No. 20040185231A1 to Dimmick, describes a method of coating a substrate surface such as concrete and with a polymer base coat on the substrate surface, placing a printed sheet on at least a portion of the base coat and applying a polymer top coat on the printed sheet and allowing the layers to cure. This invention does not use heat to bond the printed sheet material to the polyurea or the substrate. Additionally it requires the application of at least one clear polymer topcoat over the printed sheet material. The present invention does not require the application of a clear polymer topcoat over the printed pavement marking and the sealing of the printed pavement marking is by the application of heat to the printed pavement marking surface.

U.S. Pat. No. 5,173,560 to Gras, et. al., and assigned to Huels Aktiengesellschaft, describes a cold-curing, solvent-free, duroplastic two- or one-component polyurethane-polyurea compound wherein the composition provides coating, sealing, or encapsulating a substrate. This invention relates to a polyurea/polyurethane formulation. The present invention acknowledges the need for a commercially available polyurea/polyurethane formulation to adhere to the concrete substrate and to chemically bond to the thermoplastic printed pavement marking and the concrete substrate when heat is applied thereto.

U.S. Pat. No. 6,787,596 to Maier, et. al., and assigned to SKW Bauchemie, GmbH, describes a solvent-free polyurethane-polymer hybrid dispersion having a high solids content of polymer or formulation constituents. The polyurethane-polymer hybrid dispersion proposed according to the invention can be used in an outstanding manner in formulations for sport floor coverings. This invention demonstrates the ability for polyurethane-polymer uses for sealing and strengthening concrete surfaces other than traffic surfaces. The present invention teaches to the application of printed sheets of thermoplastic pavement markings to concrete traffic surfaces but does not exclude the application of thermoplastic markings to concrete other than conventional traffic surfaces.

U.S. Pat. No. 5,985,986 to Kubitza, et. al., and assigned to Bayer Aktiengesellschaft, describes a process for the preparation of a coating which comprises applying to a waterresistant substrate an aqueous coating composition containing water and only one binder and curing said aqueous coating composition in the presence of moisture to form a polyurea coating. The present invention acknowledges the need for a commercially available polyurea/polyurethane formulation to adhere to the concrete substrate and to chemically bond to the thermoplastic printed pavement marking and the concrete substrate when heat is applied thereto.

U.S. Pat. No. 6,679,650 to Ennis Paint includes the development of a thermoplastic contrast marking (black/white). The patent includes an example of a generic formulation that is similar to the present invention.

PCT application WO 03/064771 A1 to Avery Dennison requires using a structural adhesive for sealing the perimeter edge of a pavement marking. This invention, however, teaches away from the present invention in that it provides for the distinction that penetration of the concrete surface occurs due to a lower viscosity. Additionally, recommendations in the application are provided regarding the use of a caulking gun (implying high viscosity) for the recommended structural adhesives. No mention of detectable warning products is provided anywhere in the application.

U.S. Pat. No. 4,960,620 to House, et. al., and assigned to UOP, describes a method for coating or patching pavement with a polyurethane or polyurea composition and a primary amine-free curing composition that will react at ambient conditions to form said polyurethane or polyurea composition. This invention teaches the use of secondary diamines that act as chain extenders with urethane prepolymers as generally effective curing agents for a broad range of urethane prepolymers at elevated temperatures. The present invention allows for the use of commercially available polyureas as a coating agent on the substrate whereby the thermoplastic pavement marking is applied and heat is introduced to bond the thermoplastic pavement marking, polyurea and concrete substrate.

This inventive concept is not useful for green or uncured concrete.

Recently, certain secondary diamines have been found to have an acceptably long pot life, and act as chain extenders with urethane prepolymers. Such secondary diamines as N,N'-dialkyl-4,4'-methylene-dianilines, N,N'-dialkyl-phenylene-diamines, and polyfunctional oligomers based thereon, are generally effective curing agents for a broad range of urethane prepolymers at elevated temperatures.

U.S. Pat. No. 6,350,823 to Goeb, et. al., and assigned to 3M Innovative Properties Company, describes a pavement marking composition comprising (a) a polyfunctional ethylenically unsaturated polymer selected from the group consisting of polyfunctional ethylenically unsaturated polyureas, polythiocarbamateureas, and polyurethaneureas comprising at least one aspartic ester polyamine-derived segment and at least one polycarbonate, polyether, or polyestor segment; and (b) at least one ethylenically unsaturated monomer. This invention describes the actual pavement marking and a process using a polyfunctional ethylenically unsaturated polymer to attach the pavement marking to a traffic surface wherein the composition further comprises a curing system, filler, pigment, and/or reflective elements. The invention teaches away from using heat as a curing system to adhere the pavement marking to the traffic surface.

Relative to known liquid pavement marking compositions, the pavement marking composition of the invention provides durably bondable pavement markings that surprisingly exhibit both improved cold impact (snow plow) resistance and improved wear resistance, even though these characteristics are generally difficult to simultaneously achieve and/or enhance. The composition can be easily applied (e.g., by hand using a trowel or a drawbox or by spraying), without the need for expensive and/or bulky heating equipment, and cures in a reasonable amount of time at any of a wide range of commonly-encountered temperatures. Furthermore, since the composition does not contain either solvent or reactive isocyanate (nor, in preferred embodiments, low molecular weight monomer), it can be safely handled with reduced inhalation risk and environmental hazard.

With a PSA system, one uses a high molecular weight polymer with a low glass transition temperature to bond to the substrate surface. In this type of system there is no penetration into or through a Portland cement pavement substrate. The typical application method is to use heat to apply the adhesive. There are also durability issues with this type of system when exposed to shear vs. that of a thermoplastic system.

In using a thermoplastic adhesive system, one applies enough heat to the adhesive to melt or flow the material onto the pavement surface. In this system as well, there is no penetration into or through a Portland cement pavement substrate. Once the heat is removed, the adhesive cools and is bonded to the pavement surface. In this type of system, adhesives that have a glass transition temperature higher than ambient can be used.

U.S. Pat. No. 6,521,718 to Goeb, et. al., and assigned to 3M Innovative Properties Company, is a continuation of U.S. Pat. No. 6,350,823 and describes a pavement marking composition comprising a polyfunctional ethylenically unsaturated polymer selected from the group consisting of polyfunctional ethylenically unsaturated polyureas, polythiocarbamateureas, and polyurethaneureas comprising at least one aspartic ester polyaimine-derived segment and at least one polycarbonate, polyether, or polyestor segment and at least one ethylenically unsaturated monomer. The invention teaches away from using heat as a curing system to adhere the pavement marking to the traffic surface.

U.S. Patent Application No. 20020016421A1 to Goeb, et. al., and assigned to 3M Innovative Properties Company, describes a pavement marking composition and adhesive with reduced inhalation or environmental risk. The invention teaches away from using heat as a curing system to adhere the pavement marking to the traffic surface.

U.S. Pat. No. 4,118,376 to Predauin, et. al., and assigned to Bayer Aktiengesellschaft, describes an adhesive mixture formulation that is hardenable by water which, in and of itself, lends to the use of polyisocyanate component, isocyanate-containing prepolymers based on organic polyisocyanates and dispersions of polymers, polycondensates or polyaddition products in organic polyhydroxyl compounds in areas where moisture is inherently present. The present invention recognizes these compositions and utilizes them to create a hardenable surface in an uncured concrete substrate for the application of thermoplastic pavement markings recognizing that by the application of heat, the thermoplastic pavement markings and the polymers will bond with the uncured concrete forming a bonded surface of all three components.

Japanese Patent Application No. JP10183783A2 (and most recently JP03029404B2) to Iizuka, et. al., and assigned to San Techno Chemical KK, describes a polyurea resin coating layer which is formed on the surface of concrete in the wet state to integrate a water proof film with hard concrete. This processing is preferably conducted for concrete within 7 days after placing. Further a primer layer may be formed on the concrete surface and then a polyurea resin coating layer may be formed, and further the polyurea resin coating layer may be formed without formation of a primer layer. In this case, the primer may be one kind, a single, or two or more kinds of primers, may be combined, and they contain an epoxy resin composition or a polyurethane resin composition. The application does not include any discussion or application for detectable warning devices or the use of heat treating to complete the process.

BRIEF DESCRIPTION OF THE DRAWINGS

FIG. 1 is a micrograph showing the penetration of the thermoplastic signage and adhesive into the concrete substrate.

DETAILED DESCRIPTION OF THE DRAWINGS

FIG. 1 is a micrograph showing the penetration into the concrete substrate [10] of the sealer [20] and the thermoplastic signage [30].

SUMMARY OF INVENTION

The present invention relates to a system, a method and composition for adhering detectable warning devices, pavement markings and preformed traffic control devices (turn arrows, stop bars) that are hydrocarbon or alkyd thermoplastic in nature to a concrete traffic surface to provide permanent pedestrian and traffic control markings.

Specifically it relates to a system, method and composition for adhering thermoplastic or preformed thermoplastic detectable warning devices, pavement markings and preformed traffic control devices (generally known as thermoplastic signage) to uncured, or "green" concrete by coating the uncured concrete with a commercially available low viscosity polyurea epoxy primer composition and laying a sheet of preformed thermoplastic signage over the epoxy primer surface, applying heat to the preformed thermoplastic signage at sufficient temperature to allow the polyurea epoxy primer and preformed thermoplastic signage to flow into the concrete substrate pores thereby reactively binding the combination of the primer, the preformed thermosplastic signage, and the concrete compositions into a single semi-hemogeneous concrete surface and substrate. The present invention does not require preheating of Portland cement concrete or asphaltic pavement surface. It does not require removal of laitance on Portland cement concrete, it also can be used on Portland cement concrete that remains moist throughout its lifetime due to lack of water drainage in the surrounding area.

Preferably the concrete has been poured and shaped from about 24 hours to about 48 hours before the polyurea composition, either as a one-part or a two-part composition, is applied to the area where the thermoplastic signage will be placed. Longer periods than 48 hours are also applicable depending on the cure rate of the Portland cement concrete and the moisture content in the surrounding soil. Some concrete substrates remain moist throughout their lifetime due to lack of water drainage in the surrounding area. Preferably within about 20 minutes of application of the surface moisture curable polyurea coating, or from about 1 minute to about 60 minutes depending on the ambient temperature, a sheet of adhesive is applied over the area where the polyurea composition is applied and heated preferably from about 400 degrees F. to about 425 degrees F. The thermoplastic signage would be laid over the area to which the adhesive is applied. The thermoplastic signage is then leveled or evened out preferably by rolling over the thermoplastic signage. Alternatively, for some compositions the adhesive layer could be eliminated and the preformed thermoplastic signage could be applied directly to the polyurea material and heated in place.

Preferably, additionally the edges of the thermoplastic signage may be reheated to a temperature from about 400 degrees F. to about 425 degrees F. wherein the thermoplastic signage would additionally flow such that the combination of the uncured polyurea composition and the partially cured concrete substrate provides a stronger bond.

Preferably the viscosity of the polyurea composition applied to the partially cured concrete is about 100 centipoise to about 300 centipoise.

One embodiment of the invention provides a method for bonding a preformed thermoplastic road marker with top surface signage to uncured concrete exhibiting latience; providing a first underlying substrate consisting of the uncured concrete that includes an epoxy polymer in a viscosity range of 100 to 300 centipoise that seeps into the uncured concrete; mating the preformed thermoplastic road marker with a second overlying layer with top surface signage to the uncured concrete, wherein the epoxy polymer cures and seeps in the presence of moisture and wherein the epoxy polymer is a mixture consisting of; an isocyanate-functional prepolymer, an effective amount of terpene-phenolic resin providing sufficient curing with the first underlying substrate and the preformed thermoplastic road marker and an effective amount of a silane compound providing inorganic to organic chemical bonding with the first underlying substrate and the top surface signage and wherein; the second overlying layer also is forming a chemical and/or physical bond with the preformed thermoplastic road marker during heating and in the presence of moisture such that the top surface signage of the preformed thermoplastic road marker also strongly bonds onto and into the first underlying substrate, resulting in a final combined bond strength of the preformed thermoplastic road marker, the second overlying layer with signage, and the first underlying substrate equals or exceeds 180 psi between all layers for completing a combined concrete bonded preformed thermoplastic road marker with top surface signage.

DETAILED DESCRIPTION OF THE INVENTION

The present invention relates to a method for adhering thermoplastic detectable warning devices, pavement markings and preformed traffic control devices (turn arrows, stop bars) that are hydrocarbon or alkyd thermoplastic in nature (generally known as thermoplastic signage) to an uncured concrete traffic surface to provide permanent pedestrian and traffic control markings. Traffic signage may be applied using this method preferably from about 24 hours to about 48 hours after pouring or shaping, although in many cases concrete may remain moist for longer periods due to the moisture content of the surrounding soil. In the present invention there is no need for preheating of the pavement, or removal of laitance on Portland cement concrete.

The present invention utilizes a low viscosity polyurea composition from about 100 centipoise to about 300 centipoise which allows rapid penetration into the pores of uncured concrete substrate surfaces. Without being bound by any particular theory, polyurea of the specified viscosity appears to penetrate through the moisture into the concrete substrate before curing.

The curative systems may also include amine-terminated chain extenders in the formulation. Suitable chain extenders include, but are not necessarily limited to aliphatic, aromatic and cycloaliphatic diamine chain extenders.

Polyurea compositions may be comprised of one-part, two-part or several component mixtures that may be premixed or blended on site and may remain in a liquid state (known as pot life) from seconds to days. Preferably the low viscosity polyurea composition will remain viable from about 1 minute to about 60 minutes.

In addition to polyurea compositions, other curable systems of a sufficiently low viscosity to penetrate the concrete surface are selected from the group comprising one- and two-part epoxies, multi-component polyurethanes, silicone adhesives, UV/EB curable adhesives, UV/EB curable resins and combinations thereof.

All Portland cements are hydraulic cements that set and harden through a chemical reaction with water. During this reaction, called hydration, a node forms on the surface of each cement particle. The node grows and expands until it links up with nodes from other cement particles or adheres to adjacent aggregates.

It is during hydration that an applied low viscosity polyurea seeps into and is chemically reactively bonded to the concrete. An adhesive, thermoplastic, or preformed thermoplastic sheeting is placed over the polyurea/concrete substrate and heated to where the adhesive sheeting melts into the polyurea/concrete substrate becoming a semi-homogeneous mixture. Thermoplastic signage can then be applied and smoothed or leveled over the semi-homogeneous mixture and can then be heated to a temperature to melt the thermoplastic material into the semi-homogeneous mixture, thereby creating a chemically reacted bonded layered product.

Heating of the surface of the thermoplastic signage and the adhesive layer may be accomplished by a heating means such as the FLINT 2000EX® heat gun, manufactured by Flint Trading, Inc., or can be accomplished with an open flame, a closed flame, by heated roller, electrically resistive heating or other means known to those skilled in the art.

Testing has found that the low viscosity polyurea composition and thermoplastic signage may penetrate the concrete substrate surface in depth ranging from about 0.01 mm to about 10 mm. Micrographs of the penetration into uncured concrete are shown in FIG. 1.

These penetration depths provide bond strength of from about 200 psi to about 500 psi when the thermoplastic signage substrate is heated to a surface temperature from about 400 degrees F. to about 450 degrees F.

The heat source is then removed from the thermoplastic signage and the mixture is allowed to cool thereby returning the mixture from a molten state to a semi-molten state and finally to a hardened state as one substance that includes the concrete substrate.

The re-application of heat, useful in particular, to bond the thermoplastic signage edges, will allow the edges to flow penetrating into the semi-homogeneous mixture and into the concrete providing stability toward mechanical damage (such as plows) and edge peeling.

The application of cool water after a heated state will hasten solidification, strengthening and curing of the mixture.

Installation Instructions

TopMark®

Preformed Thermoplastic Detectable Warning Material

Instructions for installation on uncured or wet Portland cement concrete using a two-component sealer First-time installers should contact Flint Trading, Inc. for product support and on-site training Material Handling Instructions:

TopMark® Detectable Warning Material is supplied as a kit that contains a domed preformed thermoplastic surface material and a preformed thermoplastic adhesive material. TopMark® Detectable Warning Material should be kept dry at all times—in storage, in transit and on the project. Avoid extreme storage temperatures. TopMark® Detectable Warning Material should be stored in a building that is between 35° F. and 90° F. The boxes should be stored flat and stacked a maximum of 5 boxes high for the domed surface preformed thermoplastic material and a maximum of 20 boxes high for the adhesive preformed thermoplastic material. TopMark® Detectable Warning Material should be handled with care, as it is brittle when it is not installed. Shelf life is 12 months when stored properly. Store the TopMark® Sealer at room temperature. Do not allow to freeze. Keep containers tightly sealed.

Safety Precautions:

Protective clothing should be worn during installation of TopMark® Detectable Warning Material. The protective clothing should consist of leather boots or work shoes, long pants (note: synthetic fabrics should be avoided), gloves, and safety glasses (supplied with the TopMark® Sealer). The TopMark® Sealer is for outdoor use only. Read the enclosed Material Safety Data Sheet prior to using the TopMark® Sealer. Use only metal cans for mixing the TopMark® Sealer. The TopMark® Sealer develops heat after it has been mixed and it will melt through a plastic container. Unused mixed TopMark® Sealer will develop heat. If this happens, let the mixed TopMark® Sealer cool down in the air. Do not use water for cooling. Always wear the supplied latex gloves or other non-absorbent gloves and safety glasses when handling or working with the TopMark® Sealer. Wash with soap and water for at least 15 minutes any skin which accidentally has been in contact with the TopMark® Sealer. Remove contaminated clothing. Destroy contaminated leather. Seek medical attention if irritation persists. Use leather work gloves or other heat shielding gloves and safety glasses when installing the TopMark® material.

Surface Preparation:

Temperature: Ambient and surface temperature must be 45° F. and rising.

Moisture: Remove standing or surface moisture by drying the installation area with a propane torch.

Surface: Prepare the application surface for the adhesive material. Concrete must be free of dirt, dust, chemicals or significant oily substances. Do not apply on top of previous markings or coatings. If a formed pattern (such as an expanded metal imprint) exists in the substrate, this can be either "filled in" by using additional layer(s) of adhesive material, or leveled out by using a grinder.

Deicing chemicals and remaining curing compounds must be removed by high-pressure washing the installation area prior to installation.

Lay out the TopMark® material to be installed and apply 2 in.-4 in. wide duct tape around the installation area. See FIG. 1.

TopMark® Sealer: Use only the provided metal cans for mixing the TopMark® Sealer. The TopMark® Sealer develops heat after it has been mixed and it will melt through a plastic container. Pour part "A" into the part "B" can (see FIG. 2) and mix the contents thoroughly using the provided stirrer. See FIG. 3. This amount of TopMark® Sealer will in nearly all cases be sufficient for installing 2 sheets of TopMark®. Immediately after adding part "A" to part "B" and stirring the mixture, apply the sealer to the area of application. See FIG. 4. Do not mix more TopMark® Sealer than what is needed for one ramp as the TopMark® Sealer must be used immediately after mixing, and because excessive heat is developed if larger volumes are mixed. Do not use mixed TopMark® Sealer that has turned brown, started to develop heat, or started to thicken.

Using the supplied disposable paint brush, spread out the mixed TopMark® Sealer to the entire installation area, using one can of the A/B mixture per two sheets of TopMark® (FIG. 5). If the concrete absorbs the TopMark® Sealer readily, keep applying TopMark® Sealer until a layer of TopMark® Sealer remains on the surface, with little or no aggregate protruding the TopMark®

Sealer surface. Use additional TopMark® Sealer if necessary. The TopMark® Sealer should appear like a heavy coat of paint, leaving a shiny surface. Be ready to install the TopMark® material as soon as the TopMark® Sealer has been applied to the concrete. Do not wait for the TopMark® Sealer to cure up. Remove the duct tape when sufficient TopMark® Sealer has been applied.

Installation of TopMark® Material:

A two-person application team is recommended.

1. As soon as the TopMark® Sealer has been applied, and while it is still runny like water, apply the sheets of adhesive material needed to cover the installation area. Immediately heat the adhesive material applied in section 1 and 2 using the FLINT 2000EX heat gun until it reaches 420° F. and any bubbling in the adhesive has subsided. Keep the nozzle of the FLINT 2000EX heat gun approximately 8 in. above the adhesive material. See FIG. 6. Do not overheat the adhesive material. If overheated, wait for the temperature to drop to 420° F. before going to step 6.

2. Once the 420° F. temperature has been reached, immediately position in section 1 the first sheet of the domed surface material on the molten adhesive material surface with the truncated domes up. Place domed sheet as shown in FIG. 7. If the material is installed on a slope and the material slides, let the installed material cool off slightly and carefully slide it back to its original position.

3. Using the TopMark® Roller, immediately roll the domed surface material to eliminate air pockets and thereby ensure proper bonding with the adhesive material. See FIG. 8. A light pressure should be applied to the roller while doing one forth and one back stroke. Roll the material all the way to the edges taking care not to get the adhesive material on the roller. Avoid rolling the domes. Spray rollers with a wax-spray like WD 40 or a silicone spray to avoid adhesive material sticking to the rollers.

4. Once rolling is completed in section 1, heat the adhesive material in section 3 until it has reached 420° F. Immediately thereafter reheat the adhesive material in section 2 until it has reached 420° F. While reheating the adhesive material sections, keep the flame directed away from the already installed domed surface material to prevent overheating the domes. Once the 420° F. temperature has been reached, immediately position the next sheet of domed surface material (into section 2) without leaving gaps between the pieces of material. Once the domed surface material has been applied, immediately roll it as in step #3.

5. Continue this pattern until the Top Mark® Detectable Warning Material has been installed in the entire application area.

6. After installing all the TopMark® Detectable Warning Material, begin heating the area outside the outer edges of the material by moving the flame from the FLINT 2000EX® quickly, but steadily and keep the flame directed away from the installed material. Continue heating the area outside the edges of the material only until all of the edges "fall" and have sealed with the adhesive material. See FIG. 9. At this time the edges should be rolled with the TopMark® Edge Roller. Apply only enough pressure to ensure a good seal with the adhesive material. See FIG. 10. If excessive pressure is applied the material will be deformed. Do not apply direct heat to any part of the material other than near the edges. Do not apply direct heat to the domes. If the color bleaches or if the domes start to flatten, raise the torch and immediately move the flame to an unheated area.

7. TopMark® Detectable Warning Material will cool and set within approximately 20 minutes of application in 75° F. ambient temperature. If desired, setting time can be accelerated with a spray of cool water.

8. Excess adhesive material along the outer edges can be removed with a putty knife or a utility knife.

9. The bond strength can be tested by trying to pry a short segment of the outer edge of the material up with a putty knife. It will be difficult to pry the material if it has been installed correctly.

Do not put two pieces of preformed thermoplastic adhesive material together as they will bond to one another, especially in hot weather. Use the treated sheets to avoid this situation.

Do not throw or drop TopMark® Detectable Warning Material. In lower temperatures it will be less flexible than in warm weather.

You can "cut and paste" with TopMark® Detectable Warning Material. The adhesive material can be cut at ambient temperature with scissors. Using the adhesive material as a template, cut the domed surface material with scissors.

The use of polyurea elastomer systems may also include amine-terminated chain extenders in the formulation, which may preferably be placed within the (B) component. Suitable chain extenders include, but are not necessarily limited to, those aliphatic and cycloaliphatic diamine chain extenders mentioned in U.S. Pat. Nos. 5,162,388 and 5,480,955, incorporated herein by reference. Aromatic diamine chain extenders may also be useful, such as those described in U.S. Pat. No. 5,317,076, incorporated herein by reference.

Examples II & III

The next Examples used the same primer as Example I (Primer A). The primer was also brush applied to the concrete samples. Prior to any treatment, the concrete samples were sand blasted to remove any dust and dirt that may be present. Concrete samples were also soaked in water for a period of 24 hours to prepare the "wet" concrete samples. For the "wet" concrete, the concrete samples were placed in standing water after application of the primer and/or spray polyurea elastomer for a period of 24 hours before adhesion testing. For these Examples, "Polyurea Spray System A" was applied (65 mils thick) at varying times after application of the primer to the concrete substrates. These times ranged from immediately after the primer was applied to 15 minutes, 30 minutes, 1 hour, and 24 hours. No foaming of the aromatic polyurea elastomer system was noted when applied to any of the "wet" concrete samples. The Elcometer adhesion values are given in Table II.

TABLE II

Application of the Inventive System to Concrete

| Primer/Elastomer | Example II Dry Concrete | Example III Wet Concrete |
|---|---|---|
| No primer | 310 psi | <200 psi |
| Immediate application of elastomer | >1000 psi | 400 psi |
| 15 minute wait | >1000 psi | 410 psi |
| 30 minute wait | 935 psi | 425 psi |
| 1 hour wait | 775 psi | 460 psi |
| 24 hour wait | 800 psi | 450 psi |

* 100% substrate failure was noted in all samples except for the "wet", un-primed concrete. For this sample, the water formed a barrier to mechanical adhesion.

What is claimed is:

1. A method of bonding a preformed thermoplastic road marker with top surface signage to uncured concrete exhibiting laitance comprising;

a) providing a first underlying substrate consisting of uncured concrete and applying an epoxy polymer that has a viscosity in the range of 100 to 300 centipoises upon the uncured concrete such that the epoxy seeps into the uncured concrete;

b) mating a preformed thermoplastic road maker with a second overlying layer with top surface signage upon said epoxy coated surface of the uncured concrete to form a laminate, wherein said epoxy polymer is a mixture consisting of an isocyanate-functional prepolymer, a silane and an amount of terpene-phenolic resin effective to provide curing;

c) heating said laminate in the presence of moisture to form a concrete bonded preformed thermoplastic road marker with top surface signage whereby the final bond strength exceeds 180 psi between all layers.

2. The preformed thermoplastic road marker method according to claim 1, wherein said uncured concrete has been previously shaped and formed within about 24 hours to about 2 weeks.

3. The method according to claim 1, wherein said first underlying substrate requires no laitance removal.

4. The method according to claim 1, wherein said curable epoxy within said first underlying substrate remains uncured for at least 1 minute.

5. The method according to claim 1, wherein said thermoplastic signage meets AASHTO (American Association of State Highway road marker Transportation Officials) Designation M 249-98 specifications.

6. The method according to claim 1, wherein the means of said heating comprises an open flame, closed flame, and/or an electronic resistive source in a torch or heated roller form.

7. The method according to claim 1, wherein said heating occurs more than one time when application of said thermoplastic signage of said overlying to said underlying substrate occurs.

8. The method according to claim 1, wherein said heating elevates the temperature of said thermoplastic signage to about 400 degrees F. to about 450 degrees F.

9. The method according to claim 8, wherein said thermoplastic signage softening point is from about 400 degrees F. to about 450 degrees F. as determined by ring and ball testing methods.

10. The method according to claim 1, wherein said heating of said thermoplastic signage together with said thermoplastic road marker causes said thermoplastic signage to flow into said first underlying substrate to a depth from about 0.001 mm to about 10 mm.

11. The method according to claim 1, wherein said bond strength is from about 200 psi to about 500 psi.

* * * * *